United States Patent [19]

Koch

[11] 4,342,339

[45] Aug. 3, 1982

[54] WEAVING HEDDLE

[75] Inventor: Bernhard R. Koch, Horgenberg, Switzerland

[73] Assignee: Grob & Co. Aktiengesellschaft, Horgen, Switzerland

[21] Appl. No.: 167,485

[22] Filed: Jul. 11, 1980

[30] Foreign Application Priority Data

Jul. 30, 1979 [CH] Switzerland ..... 6999/79

[51] Int. Cl.[3] ..... D03C 9/04

[52] U.S. Cl. ..... 139/93; 139/96

[58] Field of Search ..... 139/91, 92, 93, 94, 139/96

[56] References Cited

U.S. PATENT DOCUMENTS

| | | | |
|---|---|---|---|
| 1,847,579 | 3/1932 | Turner | 139/93 |
| 3,895,655 | 7/1975 | Swjdak et al. | 139/92 |
| 3,960,182 | 6/1976 | Schwarz | 139/93 |
| 4,155,379 | 5/1979 | Graf | 139/96 |

FOREIGN PATENT DOCUMENTS

| | | | |
|---|---|---|---|
| 1535849 | 1/1970 | Fed. Rep. of Germany | 139/93 |
| 1371678 | 7/1964 | France | 139/95 |

*Primary Examiner*—Henry Jaudon

*Attorney, Agent, or Firm*—Watson, Cole, Grindle & Watson

[57] ABSTRACT

A weaving heddle includes an elongated heddle shaft having U-hook shaped end loops at opposite ends for holding the heddle on opposed heddle carrying rods of a heddle frame. The loops include shanks for overlapping with the rods, and the loops have inner support surfaces spaced a predetermined distance apart and extending transversely of the shaft for engagement with the rods. One of such support surfaces is resiliently biased toward the other of such surfaces for accommodating any increase in such predetermined distance.

5 Claims, 3 Drawing Figures

WEAVING HEDDLE

BACKGROUND OF THE INVENTION

This invention relates to a weaving heddle having an elongated heddle shaft and U-hook shaped end loops on opposite ends for holding the heddle on opposed heddle carrying rods of a heddle frame, the loops including shanks for overlapping with the rods.

Weaving heddles with laterally open end loops engaging riderless heddle frames are generally known, such weaving heddles on the heddle carrying rod being freely movable without being hindered by rod holders so that the heddles may follow even the slightest movement of the warp ends. The easy movability of the heddles on the heddle carrying rod, moreover, makes it possible, with a dense setting of the heddles, to easily divide them manually if necessary in order to eliminate downtime of the machine.

The easy movability of these weaving heddles on heddle carrying rods is effected by the prevailing play or tolerance between the heddles and the heddle carrying rods which results from the difference between the distance of the spaced inside support surfaces at the loop ends and the distance between the outer edges of the two heddle carrying rods against which the end loops strike during the oscillating movement of the heddle frame. This occurs at each reversal of movement of the heddle frame and the resulting striking of the heddles against the heddle carrying rods contributes in a substantial manner to development of the noise level in weaving rooms and, on the other hand, causes wear and tear.

Thus, attempts have been made to reduce the tolerance or play between the end loops of the heddles and the heddle carrying rods to achieve as small a tolerance as possible while at the same time assuring movability of the heddles on the heddle carrying rods. Prior approaches have, however, not been altogether successful.

SUMMARY OF THE INVENTION

It is therefore an object of the present invention to provide a weaving heddle which is characterized in such a manner that the distance between the support surfaces at both end loops which engage opposed heddle carrying rods of a heddle frame, is made variable by the provision of one of the support surfaces as resiliently biased toward the other of such surfaces for accommodating any increase in such distance.

Another object of the present invention is to provide the resiliently biased support surface as a spring element surrounding one of the end loops, the spring element having a surface facing the other support surface and being compressible in a longitudinal direction of the shaft, and the spring element being secured in place. The spring element may be a coil compression spring.

Various types of repair heddles are known but are, however, limited and difficult to handle. One of such heddles has a two-part or divided end loop at opposite ends in the form of two spring strip steel plates welded to the shaft ends. Both spring acting plates are hook-shaped and overlap with the hook-shaped ends from opposite sides over the heddle carrying rods so that, while in a hanging condition, the heddle carrying rods are enclosed as in the manner of an O-shaped end loop. The advantages in using heddles with laterally open end loops on riderless heddle frames cannot therefore be achieved because the back side of the heddle carrying rods are connected with a rod holder which, although it does not hinder movement of the heddles with laterally open end loops, does not permit free and unhindered movability of the aforementioned repair heddle because of the end loops formed by the two plates of spring strip steel which enclose the heddle carrying rods from both sides.

These disadvantages could be avoided by overcoming any interruption of production by a heddle which is broken at one of its end loops, by the provision of a heddle having laterally open end loops except that this requires manual skill to carry out the repair work on the end of the heddle shaft at which the damaged end loop must first be removed by threading the heddle shaft through slots or holes and then bending the shaft in some manner. This becomes quite difficult to accomplish and could result in damaging adjacent heddles when the heddles are densely arranged in the middle of a heddle frame.

The heddle according to the invention may be utilized as a repair heddle capable of being inserted in a simple manner at any time into the heddle frame for replacing either a broken or a damaged heddle or for increasing the number of heddles in the heddle frame at a later stage. The present heddle does not possess the disadvantages of prior repair heddles, since it does not have end loops which hinder movability of the heddle or which require experience and manual skill to carry out the necessary repair work. The heddle according to the invention has the advantage that its open, U-hook shaped end loops will not be hindered by rod holders used on riderless heddle frames. Moreover, the inner support surfaces at the end loops, one of which is formed by a spring member having a surface which is movable upon compression of the spring in a longitudinal direction of the shaft, are spaced a predetermined distance apart for securely holding the heddle in place on the opposed heddle carrying rods of the heddle frame. Because of the resiliency at the one support surface, the heddle may be easily moved when necessary on the heddle carrying rods, and the heddle may be moved from a vertical position to an inclined position relative to the heddle carrying rods without difficulty. Thus, a resiliently biased support surface functions to accommodate an increase in the predetermined distance between the support surfaces at the opposing end loops, and further permits the heddles to be easily and quickly installed.

Other objects, advantages and novel features of the invention will become more apparent from the following detailed description of the invention when taken in conjunction with the accompanying drawings.

DETAILED DESCRIPTION OF THE INVENTION

Figure 1:
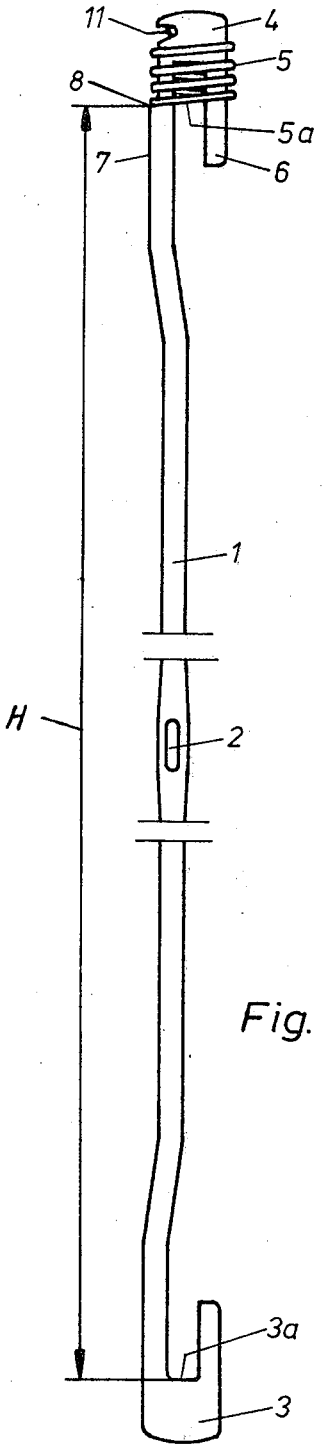
FIG. 1 is a side elevational view of a weaving heddle having a coiled compression spring surrounding oen of the end loops, in accordance with the invention.

Turning now to the drawings wherein like reference characters refer to like and corresponding parts throughout the several views, the heddle shown in FIG. 1 includes a heddle shaft 1 having a thread eye 2 disposed lengthwise at its center, and having U-hook shaped end loops 3 and 4 integrally formed at opposite ends. The end loops have flattened outer contours as typically shown in FIG. 3, and end loop 4 is surrounded by a coil compression spring 5 which is secured thereto in such a manner that it cannot fall off but is at the same time compressible at its inner end in a longitudinal direction of the heddle shaft toward the outer end of the end loop. The spring has a corresponding flattened contour (FIG. 3), and an end 5*a* of the spring, which is disposed transversely of the heddle shaft and which faces the opposing end loop 3, defines an inner support surface of the heddle for engagement with one of two heddle carrying rods of a heddle frame (not shown). The other end loop 3 has an inner support surface 3*a* for engagement with the other of the two heddle carrying rods. Distance H between support surfaces 3*a* and 5*a* is such as to permit the weaving heddle to be mounted in place on the heddle carrying rods with little or no play or tolerance therewith. And, because support surface 5*a* is resiliently biased toward support surface 3*a*, the heddle according to the invention is capable of accommodating any increase in distance H such as when it becomes necessary to move the heddle from a vertical position to an inclined position relative to the heddle carrying rods as during a heddle repair operation, and facilitates easy installation of the heddle on the heddle carrying rods.

Figure 2:
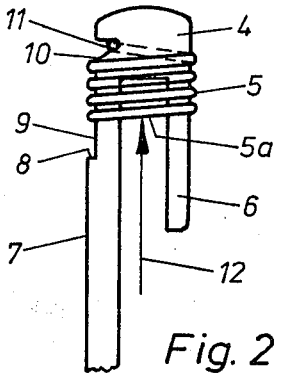
FIG. 2 is a view similar to FIG. 1, at a slightly enlarged scale, showing the end loop surrounded by the coil compression spring.
Figure 3:
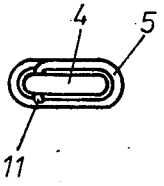
FIG. 3 is a top plan view of the FIG. 2 heddle.

As shown in FIGS. 1 and 2, end loop 4 includes a shank 6 for overlapping with one of the heddle carrying rods, a similar shank being provided for end loop 3 for overlapping with the other of the heddle carrying rods. Back-sided edge 7, opposite shank 6 of end loop 4, has a recessed section 9 terminating in a shoulder 8. Spring 5 surrounds the end loop at this recessed section and its end 5*a* engages shoulder 8 (FIG. 1) for maintaining the support surface at end 5*a* at the predetermined distance H from support surface 3*a*. A notch 10 forming another support shoulder for the spring is provided near the terminal end of loop 4 and extends inwardly a distance greater than recessed section 9. Opposite end 11 of spring 5 engages notch 10 for securely holding the spring in place while at the same time permitting the spring to be compressed in the direction of arrow 12 to thereby accommodate an increase in distance H. And, since notch 10 extends inwardly of recessed section 9, the terminal end of the spring has a smaller overall diameter as compared to the remaining coils of the spring engaging recessed section 9, due to end 11 being bent into engagement with notch 10 as shown in FIG. 3.

It should be pointed out that shank 6 of end loop 4 extends toward the corresponding shank of end loop 3 a sufficient distance beyond shoulder 8 to facilitate a secure overlapping engagement with one of the two heddle carrying rods. During installation, shank 6 overlaps with the one heddle carrying rod and spring 5 is compressed in the direction of arrow 12 as the shank at loop end 3 is overlapped with the other of the two heddle carrying rods. The heddle may thus replace any heddle which became damaged during the weaving process which most commonly occurs upon breakage of one of the heddle end loops.

From the foregoing it can be seen that a weaving heddle has been devised for quick and easy installation on the heddle carrying rods of the heddle frame when, for example, it becomes necessary to replace damaged heddles on the frame. Shank 6 is hooked over one of the heddle carrying rods so that, by pulling the heddle in a direction opposite arrow 12, spring 5 will be compressed until end loop 3 at the other end of the heddle can be hooked over the other heddle carrying rod. Release of pressure on the coil spring will then permit the shanks at both end loops to overlap the heddle carrying rods for maintaining the heddle in place thereon. Since support surface 5*a* is resiliently biased toward support surface 3*a*, distance H is made variable to permit easy installation and to permit the heddle to be inclined relative to the heddle carrying rods when necessary. One or more of the present heddles can therefore be lined up on the heddle carrying rods depending on the cross-section of the heddles and, depending on the distance between the heddle carrying rods, the present heddles may be installed with a small amount or no tolerance or free play with the heddle carrying rods.

Obviously, many modifications and variations of the present invention are made possible in the light of the above teachings. It is therefore to be understood that within the scope of the appended claims the invention may be practiced otherwise than as specifically described.

What is claimed:

1. A weaving heddle, comprising an elongated heddle shaft having U-hook shaped end loops at opposite ends thereof for holding the heddle on opposed heddle carrying rods of a heddle frame, said loops including shanks for overlapping with the rods, said loops having inner support surfaces spaced a predetermined distance apart and extending transversely of said shaft for engagement with the rods, one of said support surfaces being formed by a resilient member for allowing said distance to increase, said resilient member being urged to accommodate any such increase in said predetermined distance.

2. The heddle according to claim 1, wherein said resilient member comprises a spring member including said one surface which faces the other of said support surfaces, said spring member surface being movable in a longitudinal direction of said shaft to accommodate any increase in said distance, and said spring member being secured to one of said loops having said one support surface.

3. The heddle according to claim 2, wherein said spring member comprises a coil compression spring, said one loop having spaced recessed supporting edges thereon, and opposed ends of said coil spring engaging said supporting edges.

4. The heddle according to claim 3, wherein said coil spring surrounds said one loop, said loop having a recessed section terminating in a shoulder defining one of said supporting edges, and the other of said supporting edges being formed by a notch.

5. The heddle according to claim 4, wherein said one loop has a flattened outer contour, and said coil spring has a corresponding flattened outer contour.

* * * * *